US005607312A

United States Patent [19]

Zhou

[11] Patent Number: 5,607,312

[45] Date of Patent: Mar. 4, 1997

[54] WRITING BOARD WITH AN AUTOMATIC ERASE DEVICE

[76] Inventor: Jie-Zhang Zhou, 2451 W. Main St. #501, Alhambra, Calif. 91801

[21] Appl. No.: 372,504

[22] Filed: Jan. 13, 1995

[30] Foreign Application Priority Data

Jan. 19, 1994 [CN] China ..... 94 201554.1

[51] Int. Cl.[6] ..... B43L 1/00

[52] U.S. Cl. ..... 434/411; 434/417; 434/408

[58] Field of Search ..... 434/408, 411, 434/412, 417

[56] References Cited

U.S. PATENT DOCUMENTS

| | | | |
|---|---|---|---|
| 382,705 | 5/1888 | Kane | 434/411 |
| 1,227,205 | 5/1917 | Sartakoff | 434/411 |

FOREIGN PATENT DOCUMENTS

| | | | |
|---|---|---|---|
| 0263098 | 10/1989 | Japan | 434/411 |
| 0267099 | 10/1989 | Japan | 434/411 |
| 0271299 | 10/1989 | Japan | 434/411 |

*Primary Examiner*—Nicholas D. Lucchesi
*Assistant Examiner*—Jeffrey A. Smith
*Attorney, Agent, or Firm*—David & Raymond; Raymond Y. C. Chan

[57] ABSTRACT

A writing board with an automatic erase device includes a frame, a driving roller and a supporting roller rotatably mounted on the frame in a parallel manner, an endless writing sheet trained around the driving and supporting rollers to form a front exposed writing surface and a back surface, a supporting board interposed between the front writing exposed writing surface and the back surface of the writing sheet for providing a fixed rigid supporting to the front exposed surface, and an erase device positioned behind the back surface of the writing sheet and mounted on the frame. The erase device includes at least an elongated eraser which is extended along a width of the writing sheet and is disposed in the touching with the back surface of writing sheet, so that a writing content on the front exposed writing surface can be erased by the eraser automatically when the writing sheet is rotated by the driving roller.

12 Claims, 4 Drawing Sheets

WRITING BOARD WITH AN AUTOMATIC ERASE DEVICE

Background of the Present Invention

The present invention relates to a blackboard, and more particularly to a writing board which comprises an automatic erase device for erasing the writing on the board automatically.

The most common method of erasing a blackboard in a classroom or a meeting room is to use a hand-held eraser and to manually erase the blackboard as required. A progressive disadvantage of the conventional blackboard is that the lecturer has to stop his writing from time to time for erasing manually. The chalk dust flies in the air during the erasing. Therefore, the air will be polluted that does harm to human health.

As the size of the blackboard and the expanse of coverage increase, the people who sit at the left or right corner will find difficult to observe the writing on the far side of the blackboard due to reflection. The traditional blackboard is fixed on the wall. The writing at the bottom of the blackboard will remain at the lower position that is more difficult to be viewed by those people who sit at the back seats than the writing at a upper position of the fixed blackboard. Moreover, the lecturer has to stand in front of the blackboard while writing that will obstruct the portion of the blackboard being writing upon from the student's view.

U.S. Pat. No. 4, 462,134, and 4,742,594 are patents about the blackboard handhold eraser. U.S. Pat. No. 3,731,335 and 3,858,265 are patents concern about automatic chalkboard eraser mounted on the conventional chalkboard. The above prior arts disclose the art of eraser with unsolved drawbacks as described above.

SUMMARY OF THE PRESENT INVENTION

The main object of the present invention is to provide a writing board with an automatic erase device which cm erase the writing on an endless writing surface while it is rotated.

Mother object of the present invention is to provide a writing board with an automatic erase device which can prevent the air polluted by the chalk dust.

Another object of the present invention is to provide a writing board with an automatic erase board device which can adjust the writing at a lower position of the writing board to an upper position by rotating the writing surface.

Another object of the present invention is to provide a writing board with an automatic erase device which enables the lecturer to write upon the writing surface without obstructing any portion of the writing board.

Accordingly, the present invention provides a writing board with an automatic erase device which comprises a frame, a driving roller and a supporting roller rotary mounted in the frame, an endless flexible writing sheet formed by a raw material, such as white vinyl flexible magnet sheet, which is capable of allowing picture image written thereon to be erased. The writing sheet is trained around a driving roller and a supporting roller which are arranged in parallel to each other. The writing sheet is moved in circulation by rotating the driving roller by a motor or manually.

An automatic erase device is mounted on the back of the writing sheet. The erase device comprises at least an elongated eraser which extends along the width of the writing sheet and is disposed in touching with the writing surface of the writing sheet. A supporting board is mounted vertically between the driving and supporting rollers to provide a rigid supporting to the writing surface of the writing sheet so as to enable writing thereon. When rotates the writing sheet by means of the driving roller, writing marks on the writing surface of the writing sheet will be erased by the eraser of the erase device automatically.

The automatic erase device of the writing board of the present invention is installed in a bracket which stores the chalk or writing medium dust within the bracket to avoid pollution of air.

The writing board of the present invention can be modified to comprise a second supporting roller horizontally disposed in parallel with the driving roller. Thus, the endless writing sheet can be mounted to form a vertical portion and a horizontal portion so as to enable the lecturer to write on the top surface of the horizontal portion of the writing sheet and displace the writing content on the front exposed vertical portion of the writing sheet. The lecturer will not obstruct the viewing while writing the content.

DETAILED DESCRIPTION OF THE PREFERRED EMBODIMENT

Figure 1:
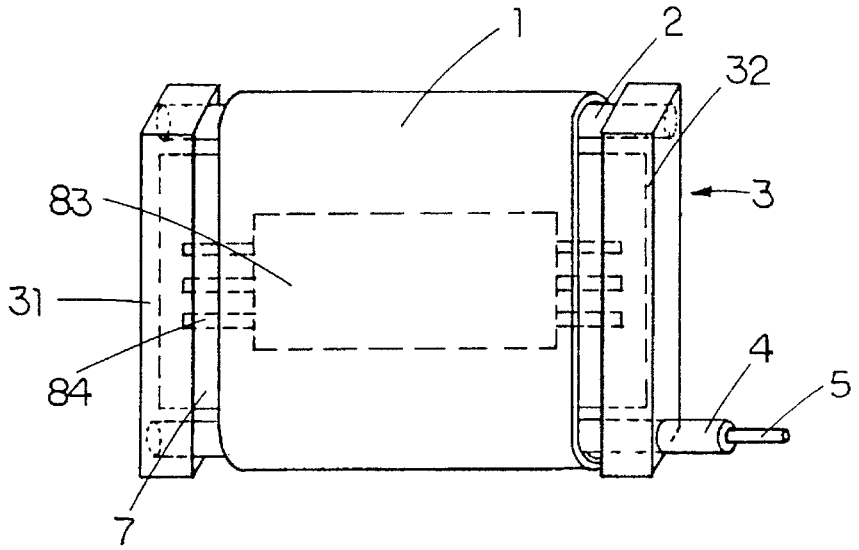
FIG. 1 is a perspective view of a writing board according to a first embodiment of the present invention.
Figure 2:
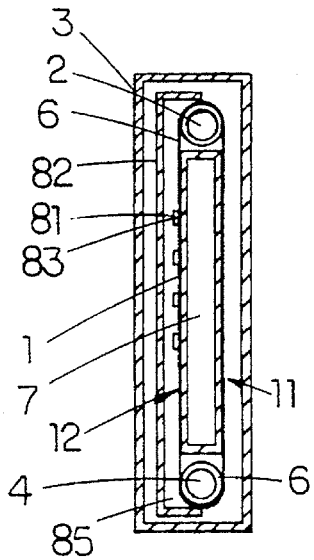
FIG. 2 is a sectional end view, illustrating a bracket, of the writing board of the above first embodiment of the present invention.
Figure 3:
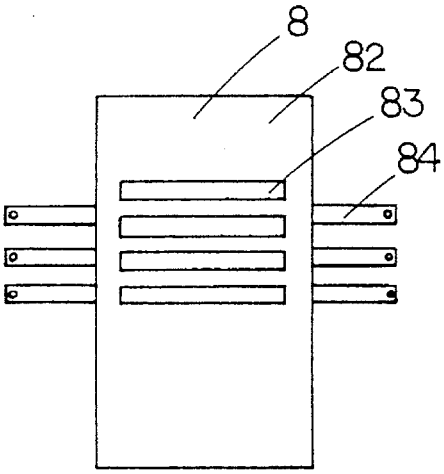
FIG. 3 is a front view of the bracket of the writing board of the above first embodiment of the present invention.

Referring to FIG. 1 to FIG. 6 there is illustrated a writing board of a first embodiment of the present invention. The writing board comprises an endless writing sheet 1, a supporting roller 2, a frame 3, a driving roller 4, and an erase device 8 (as shown in FIG. 3).

The frame 3 comprises a left unit 31 and a right unit 32 connected in parallel by a supporting board 7, such as a cardboard.

Figure 5:
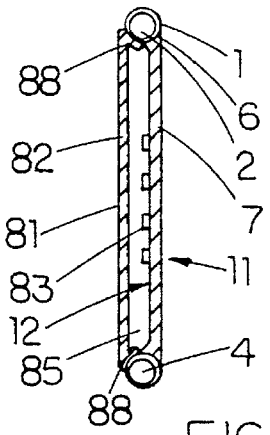
FIG. 5 is an end view of a modification structure of the writing board according to the above first embodiment of the present invention.

The driving roller 4 and the supporting roller 2 are mounted on the frame 3. The writing sheet 1 is flexible and is trained around the driving roller 4 and the supporting roller 2 to form a front exposed writing surface 11 and a back surface 12 as shown in FIG. 5. The supporting board 7 is interposed between the front and back surfaces 11, 12 to provide a fixed rigid supporting to the front surface 11 of the writing sheet 1 so as to enable writing thereon (as shown in FIG. 2). The flexible endless writing sheet 1 can be rotated clockwise or anti-clockwise around the driving and supporting rollers 4, 2 by turning the driving roller 4. The driving roller 4 can be driven to rotate by a motor (not shown in Figure) or manually through a shaft 5. The shaft 5 is connected to one end of the driving roller 4 coaxially (as shown in FIG. 1).

Figure 4:
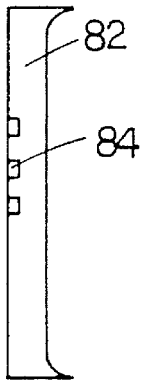
FIG. 4 is an end view of FIG. 3.

As shown in FIGS. 2 to 5, the erase device 8 is mounted behind the back surface 12 of the writing sheet 1. The erase device 8 comprises a cover board 82, at least an elongated eraser 83, a plurality of carriages 84, a plurality of springs 81, and a clutch 871: There are four erasers 83 according to the present embodiment and each has a length at least equal to the width of the writing sheet 1. The erasers 83 are mounted on the cover board 82 horizontally. The erasers 83 are made of elastic material such as foam rubber, foam plastic, and sponge, etc. The erasers extend along the width of the writing sheet and are disposed in touching with the writing surface of the 1. The carriages 84 are connected to the left and right sides of the cover board 82 respectively. The cover board 82 is secured behind the back surface 12 of the writing sheet 1 by screwing the carriages 84 to tile frame 3 with a plurality of screws 86 as shown in FIG. 4). The plurality of springs 81 are disposed between the cover board 82 and tile erasers 83 respectively in order to provide an extensive pressure to make the erasers 83 keep engaging to the back surface 12 of the writing board 1 for erasing any writing thereon. Thus, the writing on the front writing surface 11 of the writing sheet 1 can be erased automatically by the erasers 83 while rotating to the back.

The clutch 871 comprises a plurality of adjusting springs 87 which are mounted on the carriages 84. The erasers 83 can be compressed to separate from the writing sheet 1 when some writing which are not supposed be erased, as shown in FIG. 4.

In order to reduce the slipping between the driving and supporting rollers 4, 2 and the writing sheet 1, two rubbers 6 are wrapped around the driving and supporting rollers 4, 2 respectively to increase friction. The writing sheet 1 is made by a material capable of allowing writing thereon to be erased, such as the white vinyl flexible magnet sheet which is possible to write by a waterbase pen thereon and to be easily erased with a damp eraser.

The space between the cover board 82 and the back surface 12 of the writing sheet I forms a dust container 85 to collect the waste, such as chalk dust, formed while erasing the writing sheet 1. Thus, the erasing dust waste will not pollute the environment, as shown in FIG. 2 and FIG. 5.

As shown in FIG. 5, the top and bottom ends of the cover board 82 are bended inwardly respectively to form a top and a bottom V-shape holding end edges 88 in order to press the back surface 12 of the writing sheet inwardly to enable the writing sheet I maintaining a tension and decrease the thickness of the writing board.

Figure 6:
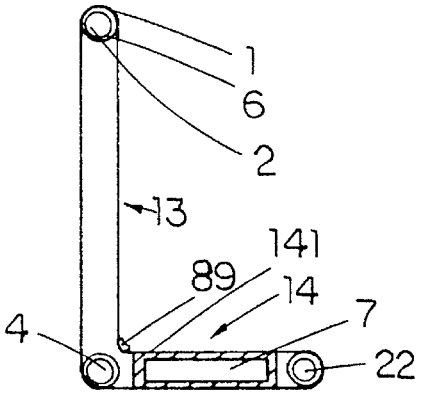
FIG. 6 is an end view of a second modification structure of the writing board according to the above first embodiment of the present invention.
Figure 7:
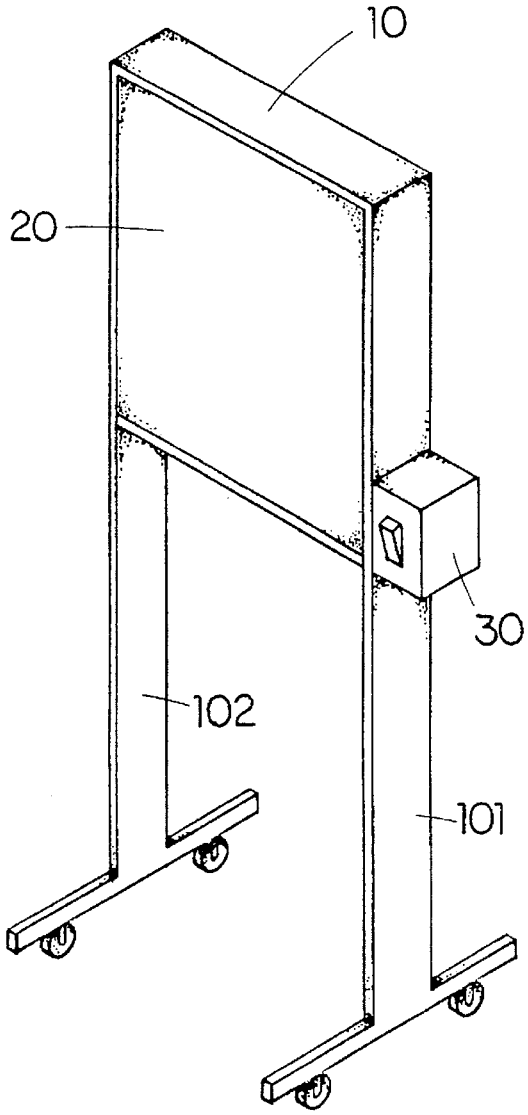
FIG. 7 is a perspective view of a writing board with an automatic erase device according to a second embodiment of the present invention.

Referring to FIG. 6, illustrating a modification of the above first embodiment, the writing board further comprises a second supporting roller 22 horizontally disposed in parallel with the driving roller 4. Thus, the endless writing sheet I can be mounted in a L-shaped manner that includes a vertical portion 13 and a horizontal portion 14. The lecturer is able to write on the top surface 141 of the horizontal portion 14 of the writing sheet 1 and displaces the writing content on the front exposed vertical portion 13 of the writing sheet I by rotating the driving roller 4. Accordingly, the lecturer will not obstruct the viewing while writing the content. A curved and elongated holding element 89 is disposed on the back surface 12 adjacent to the driving roller 4 in order to press the writing sheet I to enable the writing sheet I to maintain a tension.

Referring to FIG. 7 to FIG. 10, illustrating a second embodiment of the present invention, a writing board with an automatic erase device comprises a frame 10, an endless flexible writing sheet 20, an erase device 40, a driving roller 60, and a supporting roller 70. In which the driving roller 60, the supporting roller 70 and the writing sheet 20 are disposed in the manner of the first embodiment as described above.

The frame 10 is in rectangular shape. The two sides of the bottom of the frame extended downwardly to form a pair of standing legs 101,102. The erase device 40 comprises a top and a bottom erasers 41 mounted on a first eraser carriage and a second eraser carriage 110 respectively at the back of the writing sheet 20 and engaged to the surface of the writing sheet 20. A supporting board 50 is interposed between a front surface 21 and a back surface 22 of the writing sheet 20 to provide a fixed rigid supporting to the front exposed writing surface 21 of the writing sheet 20. Two rubbers 100 are wrapped on the driving and supporting rollers 60, 70 respectively to increase friction.

Figure 8:
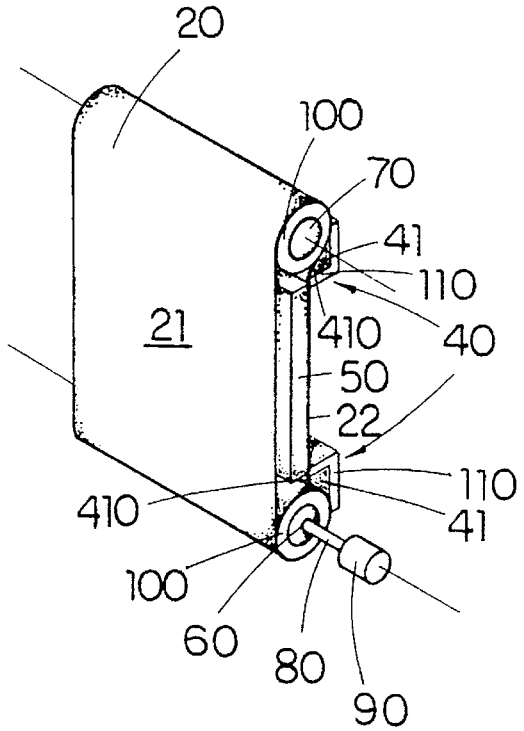
FIG. 8 is a perspective view illustrating the automatic erase device of the writing board of the above second embodiment of the present invention.

The driving roller 60 and the supporting roller 70 are mounted on the frame 10 respectively. The driving roller 60 is parallel to the supporting roller 70. The flexible and endless writing sheet 20 is trained around the driving and supporting rollers 60, 70. The driving roller 60 is coupled with the motor 90 through a shaft 80 which is connected to the driving roller 60 coaxially. The parallel erasers 41 mounted on the parallel carriages eraser 110 are engaged with the back surface 22 of the writing sheet 20. The two eraser carriages 110 in L-shaped are secured to the frame 10 in a position adjacent to the driving and supporting rollers 60, 70 respectively. The erasers 41 set on the corresponding eraser carriages 110 each has a curve erasing surface 410 pressing to and touching with the surface of the writing sheet 20, as shown in FIG. 8. Thus, the writing on the surface of the writing sheet 20 can be erased automatically by the erasers 41 as the writing sheet 20 is rotating.

Upon the operation of a operation box 30, the motor 90 rotates so that the writing sheet 20 is transferred by the driving roller 60 and is wound up by the supporting roller 70. Therefore, the pattern written on the writing sheet 20 with a waterbase pen or chalk moves backward and is erased by the fixed erasers 41.

Figure 9:
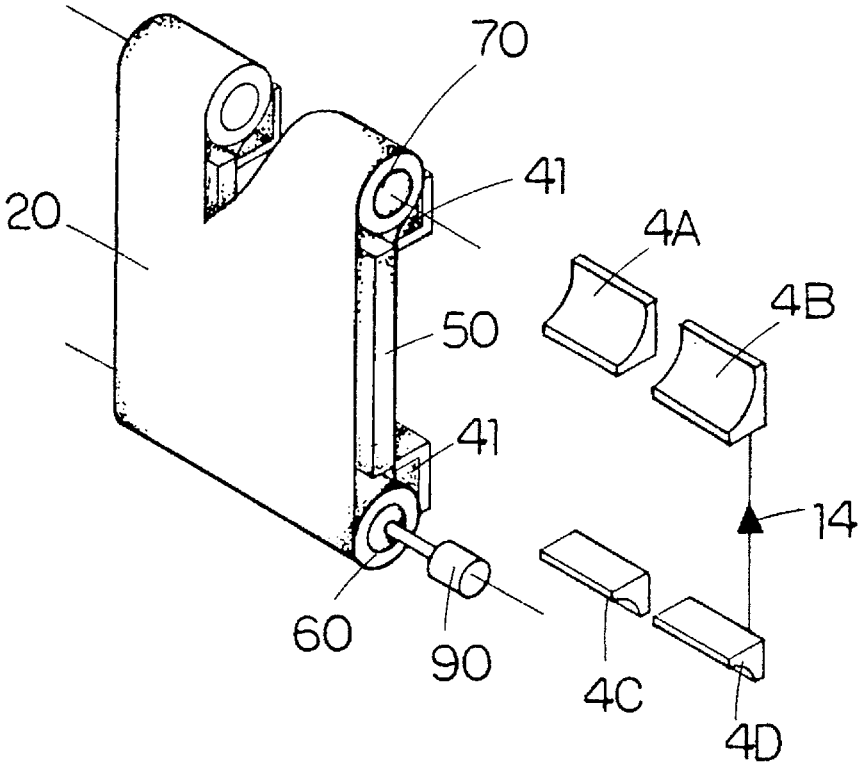
FIG. 9 is a perspective view of the inner structure of the writing board with the erasers pulled apart from the writing sheet of the above second embodiment of the present invention.

FIG. 9 illustrates a modification of the second embodiment of the present invention. The top and bottom erasers 41 are cm into two separate parts 4*a*, 4*b*, 4*c*, and 4*d* respectively. A clutch 14 is installed between the top and bottom erasers 41. Upon operating the clutch 14, the erasers 4*b* and 4*d* move away from the writing sheet 20 to avoid a predetermined portion of writing be erased.

Figure 10:
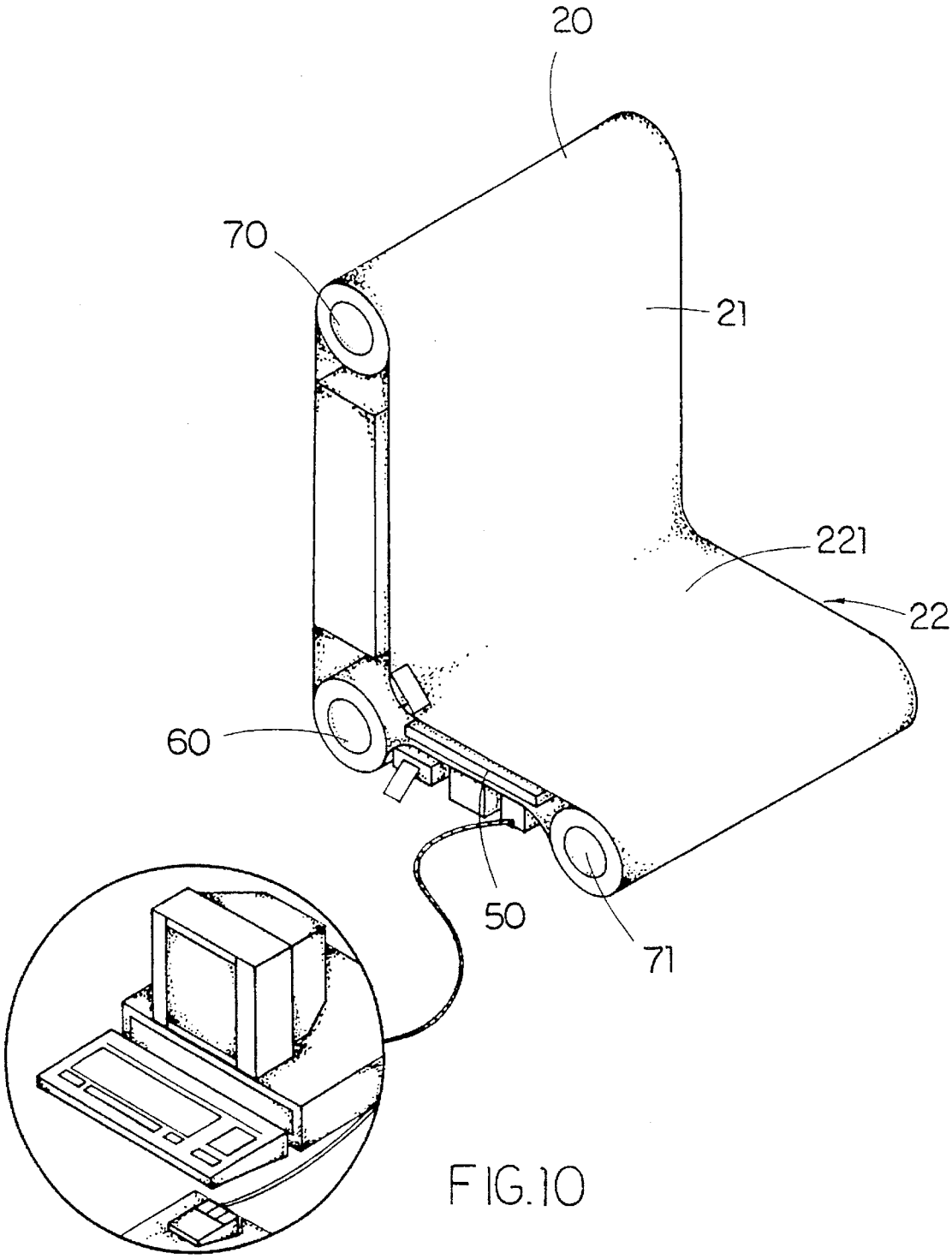
FIG. 10 is a perspective view of a modified writing board according to the above second embodiment of the present invention.

FIG. 10 further illustrates another modification of the above second embodiment of the present invention. In which the length of the writing sheet 20 is longer than that of the above second embodimemt and further comprises a second supporting roller 71. The flexible endless writing sheet 20 is then trained around the first supporting roller 70, the driving roller 60, and the second supporting roller 71 in a L-shaped manner that includes a vertical portion 21 and a horizontal portion 22. The lecturer is able to write on the top surface 221 of the horizontal portion 22 of the writing sheet 20 and displaces the writing content on the front exposed vertical portion 21 of the writing sheet 20 by rotating the driving roller 60. Accordingly, the lecturer will not obstruct the viewing while writing the content. Furthermore, this modification is also possible to be printed by using a printer through connecting with a computer and a copy machine as shown in FIG. 10.

I claim:

1. A writing board with an automatic erase device, comprising a frame having a supporting board;

a flexible and endless writing sheet;

a driving roller and a supporting roller mounted on said frame in parallel manner, in which said endless writing sheet is trained around said driving roller and said supporting roller to form a front exposed writing surface and a back surface, and that said supporting board is interposed between said front exposed writing surface and said back surface to provide a fixed rigid supporting to said front exposed writing surface of said endless writing sheet for enabling writing thereon, wherein said endless writing sheet is able to be rotated around said driving roller and said supporting roller by turning said driving roller;

an erase device, mounted behind said back surface of said endless writing sheet, comprising a cover board secured on said frame behind said back surface of said endless writing sheet, and at least an elongated eraser which has a length at least equal to a width of said endless writing sheet and is mounted on said cover board horizontally, said eraser extending along said width of said writing sheet and being disposed in touching with said back surface of said endless writing sheet, said erase device further comprising a plurality of springs which are disposed between said cover board and said eraser in order to provide an extensive pressure to enable said eraser to keep engaging with said back surface of said endless writing sheet, whereby a writing content on said front exposed writing surface is erased automatically by said eraser as said endless writing sheet is rotated; and a dust container formed between said cover board and said back surface of said endless writing sheet for collecting dust formed while erasing said endless writing sheet.

2. A writing board with an automatic erase device, as recited in claim 1, in which said erase device further comprises a plurality of carriages connected to a left side and a right side of said cover board respectively for connecting said cover board to said frame, and a clutch which comprises a plurality of adjusting springs mounted on said carriages, wherein upon compressing said adjusting springs, said eraser is separated from said endless writing sheet.

3. A writing board with an automatic erase device, as recited in claim 1, in which a top end and a bottom end of said cover board are bent inwardly respectively to form a top and a bottom V-shape holding end edge in order to press said back surface of said endless writing sheet inwardly to enable said endless writing sheet to maintain a tension.

4. A writing board with an automatic erase device, as recited in claim 1, further comprising a shaft connected to one end of said driving roller for turning said driving roller to rotate.

5. A writing board with an automatic erase device, as recited in claim 1 further comprising a second supporting roller horizontally disposed in parallel with said driving roller, in which said endless writing sheet is mounted in a L-shaped manner that includes a front exposed vertical portion between said first supporting roller and said driving roller and a horizontal portion between said driving roller and said second supporting roller, so that said writing content is capable of being written on a top surface of said horizontal portion of said endless writing sheet and displacing on said front exposed vertical portion of said endless writing sheet by rotating said driving roller.

6. A writing board with an automatic erase device, as recited in claim 5, further comprising a curved and elongated holding element which is disposed on said back surface and adjacent to said driving roller in order to press said endless writing sheet to enable said endless writing sheet to maintain a tension.

7. A writing board with an automatic erase device, comprising a frame having a supporting board;

a flexible and endless writing sheet;

a driving roller and a supporting roller mounted on said frame in parallel manner, in which said endless writing sheet is trained around said driving roller and said supporting roller to form a front exposed writing surface and a back surface, and that said supporting board is interposed between said front exposed writing surface and said back surface to provide a fixed rigid supporting to said front exposed writing surface of said endless writing sheet for enabling writing thereon, wherein said endless writing sheet is able to be rotated around said driving roller and said supporting roller by turning said driving roller; and an erase device, mounted behind said back surface of said endless writing sheet, comprising a first eraser carriage and a second eraser carriage secured to said frame in a position adjacent to said supporting roller and said driving roller respectively, and two erasers mounted on said first and second eraser carriages respectively, in which each of said erasers is extended along a width of said endless writing sheet and is disposed at a back of said endless writing sheet adapting to provided an extensive pressure to enable said eraser to keep engaging with said back surface of said endless writing sheet, whereby a writing content on said front exposed writing surface is erased automatically by said erasers as said endless writing sheet is rotated.

8. A writing board with an automatic erase device, as recited in claim 7, in which each of said first and second eraser carriages is in L-shaped and each of said erasers has a curve erasing surface pressing to and touching with said back surface of said endless writing sheet for automatically erasing said writing content on said front exposed writing surface of said endless writing sheet while the rotation of said endless writing sheet.

9. A writing board with an automatic erase device, as recited in claim 8, in which each of said erasers is cut into two separate parts, and that a clutch is installed between said two erasers for moving said erasers away from said endless writing sheet to avoid a predetermined portion of said writing content on said endless writing sheet being erased.

10. A writing board with an automatic erase device, as recited in claim 7, further comprising a shaft connected to one end of said driving roller for turning said driving roller to rotate.

11. A writing board with an automatic erase device, as recited in claim 7, further comprising a second supporting roller horizontally disposed in parallel with said driving roller, in which said endless writing sheet is mounted in a L-shaped manner that includes a front exposed vertical portion between said first supporting roller and said driving roller and a horizontal portion between said driving roller and said second supporting roller, so that said writing content is capable of being written on a top surface of said horizontal portion of said endless writing sheet and displacing on said front exposed vertical portion of said endless writing sheet by rotating said driving roller.

12. A writing board with an automatic erase device, as recited in claim 11, further comprising a curved and elongated holding element which is disposed on said back surface and adjacent to said driving roller in order to press said endless writing sheet to enable said endless writing sheet to maintain a tension.

* * * * *